US010976025B2

(12) United States Patent
Bezel et al.

(10) Patent No.: US 10,976,025 B2
(45) Date of Patent: Apr. 13, 2021

(54) PLASMA CELL FOR PROVIDING VUV FILTERING IN A LASER-SUSTAINED PLASMA LIGHT SOURCE

(71) Applicant: KLA-Tencor Corporation, Milpitas, CA (US)

(72) Inventors: Ilya Bezel, Mountain View, CA (US); Anatoly Shchemelinin, Bozeman, MT (US); Eugene Shifrin, Sunnyvale, CA (US); Matthew Panzer, San Jose, CA (US); Matthew Derstine, Los Gatos, CA (US); Jincheng Wang, San Jose, CA (US); Anant Chimmalgi, San Jose, CA (US); Rajeev Patil, Fremont, CA (US); Rudolf Brunner, Mountain View, CA (US)

(73) Assignee: KLA Corporation, Milpitas, CA (US)

( * ) Notice: Subject to any disclaimer, the term of this patent is extended or adjusted under 35 U.S.C. 154(b) by 173 days.

(21) Appl. No.: 15/895,868

(22) Filed: Feb. 13, 2018

(65) Prior Publication Data

US 2018/0172240 A1 Jun. 21, 2018

Related U.S. Application Data

(62) Division of application No. 13/741,566, filed on Jan. 15, 2013, now Pat. No. 9,927,094.

(Continued)

(51) Int. Cl.

*H01J 61/52* (2006.01)
*H01J 61/40* (2006.01)

(Continued)

(52) U.S. Cl.

CPC ..... *F21V 9/06* (2013.01); *H01J 61/125* (2013.01); *H01J 61/14* (2013.01); *H01J 61/16* (2013.01);

(Continued)

(58) Field of Classification Search

CPC .. H01J 61/10; H01J 61/34; H01J 61/38; H01J 61/40–46; H01J 37/165; H01J 37/32321;

(Continued)

(56) References Cited

U.S. PATENT DOCUMENTS 3,054,921 A 9/1962 Lye
3,682,525 A 8/1972 Knochel (Continued)

FOREIGN PATENT DOCUMENTS

JP 2005019131 A 1/2005
JP 2009181818 A 8/2009

(Continued)

OTHER PUBLICATIONS

E.E. Hoppe et al., "Near-edge optical absorption behavior of sputter deposited hafnium dioxide", J. Appl. Phys. 101, 123534 (2007).

(Continued)

*Primary Examiner* — Matthew J. Peerce
*Assistant Examiner* — Steven Y Horikoshi
(74) *Attorney, Agent, or Firm* — Suiter Swantz pc llo

(57) ABSTRACT

A plasma cell for use in a laser-sustained plasma light source includes a plasma bulb configured to contain a gas suitable for generating a plasma. The plasma bulb is transparent to light from a pump laser, wherein the plasma bulb is transparent to at least a portion of a collectable spectral region of illumination emitted by the plasma. The plasma bulb of the plasma cell is configured to filter short wavelength radiation, such as VUV radiation, emitted by the plasma sustained within the bulb in order to keep the short wavelength radiation from impinging on the interior surface of the bulb.

8 Claims, 6 Drawing Sheets

Related U.S. Application Data

(60) Provisional application No. 61/587,380, filed on Jan. 17, 2012.

(51) Int. Cl.

| | |
|---|---|
| ***F21V 9/06*** | (2018.01) |
| ***H01J 61/12*** | (2006.01) |
| ***H01J 61/14*** | (2006.01) |
| ***H01J 61/16*** | (2006.01) |
| ***H01J 61/20*** | (2006.01) |
| ***H01J 61/34*** | (2006.01) |
| ***H01J 61/35*** | (2006.01) |
| ***H01J 65/04*** | (2006.01) |

(52) U.S. Cl.
CPC ..... *H01J 61/20* (2013.01); *H01J 61/34* (2013.01); *H01J 61/35* (2013.01); *H01J 61/40* (2013.01); *H01J 61/523* (2013.01); *H01J 65/04* (2013.01)

(58) Field of Classification Search
CPC .. H01J 37/32339; H01J 37/3488; H01J 65/04; F21V 9/06
See application file for complete search history.

(56) References Cited

U.S. PATENT DOCUMENTS

| | | | |
|---|---|---|---|
| 3,748,518 | A | 7/1973 | Lewis |
| 4,461,978 | A | 7/1984 | Mikoshiba et al. |
| 4,524,299 | A | 6/1985 | Preston, III |
| 4,935,668 | A | 6/1990 | Hansler et al. |
| 4,949,005 | A | 8/1990 | Parham et al. |
| 5,608,227 | A | 3/1997 | Dierks et al. |
| 5,658,612 | A | 8/1997 | Li et al. |
| 6,052,401 | A | 4/2000 | Wieser et al. |
| 7,435,982 | B2 | 10/2008 | Smith |
| 7,705,331 | B1 | 4/2010 | Kirk et al. |
| 7,786,455 | B2 | 8/2010 | Smith |
| 2002/0145875 | A1* | 10/2002 | Roberts ..... F21V 25/04 362/294 |
| 2005/0168148 | A1 | 8/2005 | Allen et al. |
| 2007/0228288 | A1 | 10/2007 | Smith |
| 2007/0228300 | A1 | 10/2007 | Smith |
| 2007/0236119 | A1 | 10/2007 | Espiau |
| 2008/0272682 | A1 | 11/2008 | Aurongzeb et al. |
| 2009/0032740 | A1 | 2/2009 | Smith et al. |
| 2010/0264820 | A1 | 10/2010 | Sumitomo et al. |
| 2011/0181191 | A1 | 7/2011 | Smith et al. |

FOREIGN PATENT DOCUMENTS

| | | | |
|---|---|---|---|
| SU | 470019 | A1 | 5/1975 |
| SU | 1775751 | A1 | 11/1992 |
| WO | 2011100322 | A2 | 8/2011 |
| WO | 2011100322 | A3 | 8/2011 |

OTHER PUBLICATIONS

A. Schreiber et al., "Radiation Resistance of Quartz Glass for VUV Discharge Lamps", J. Phys. D: Appl. Phys. 38 (2005), pp. 3242-3250.

W. H. Parkinson et al., "Absorption cross-section measurements of water vapor in the wavelength region 181-199 nm", Chemical Physics, vol. 294, Issue 1, Oct. 1, 2003, pp. 31-35.

* cited by examiner

PLASMA CELL FOR PROVIDING VUV FILTERING IN A LASER-SUSTAINED PLASMA LIGHT SOURCE

CROSS-REFERENCE TO RELATED APPLICATION

The present application is related to and claims benefit of the earliest available effective filing date from the following applications. The present application constitutes a divisional patent application of U.S. patent application entitled PLASMA CELL FOR PROVIDING VUV FILTERING IN A LASER-SUSTAINED PLASMA LIGHT SOURCE, Ilya Bezel, Anatoly Shchemelinin, Eugene Shifrin, Matthew Panzer, Matthew Derstine, Jincheng Wang, Anant Chimmalgi, Rajeev Patil, and Rudolf Brunner as inventors, filed Jan. 15, 2013, application Ser. No. 13/741,566, which is a regular (non-provisional) patent application of U.S. Provisional Patent Application entitled VUV FILTERING INSIDE THE BULBS USED IN LASER-SUSTAINED PLASMAS ILLUMINATORS, naming Ilya Bezel, Anatoly Shchemelinin, Eugene Shifrin, Matthew Panzer, Matthew Derstine, Jincheng Wang, Anant Chimmalgi, Rajeev Patil, and Rudolf Brunner as inventors, filed Jan. 17, 2012, Application Ser. No. 61/587,380. U.S. Non-Provisional patent application Ser. No. 13/741,566 and U.S. Provisional Patent Application No. 61/587,380 are incorporated by reference herein in their entirety.

TECHNICAL FIELD

The present invention generally relates to plasma based light sources, and more particularly to gas bulb configurations suitable for filtering UV light, in particular VUV light, emitted by the laser-sustained plasma within the gas bulb.

BACKGROUND

As the demand for integrated circuits with ever-shrinking device features continues to increase, the need for improved illumination sources used for inspection of these ever-shrinking devices continues to grow. One such illumination source includes a laser-sustained plasma source. Laser-sustained plasma light sources (LSPs) are capable of producing high-power broadband light. Laser-sustained light sources operate by focusing laser radiation into a gas volume in order to excite the gas, such as argon, xenon, mercury and the like, into a plasma state, which is capable of emitting light. This effect is typically referred to as "pumping" the plasma. In order to contain the gas used to generate the plasma, an implementing plasma cell requires a "bulb," which is configured to contain the gas species as well as the generated plasma.

A typical laser sustained plasma light source may be maintained utilizing an infrared laser pump having a beam power on the order of several kilowatts. The laser beam from the given laser-based illumination source is then focused into a volume of a low or medium pressure gas in a plasma cell. The absorption of laser power by the plasma then generates and sustains the plasma (e.g., 12K-14K plasma).

Traditional plasma bulbs of laser sustained light sources are formed from fused silica glass. Fused silica glass absorbs light at wavelengths shorter than approximately 170 nm. The absorption of light at these small wavelengths leads to rapid damage of the plasma bulb, which in turn reduces optical transmission of light in the 190-260 nm range. Absorption of short wavelength light (e.g., vacuum UV light) also stresses the plasma bulb, which leads to overheating and potential bulb explosion, limiting the use of high power laser-sustained plasma light source in effected ranges. Therefore, it would be desirable to provide a plasma cell that corrects the deficiencies identified in the prior art.

SUMMARY

A plasma cell for ultraviolet light filtering suitable for use in a laser-sustained plasma light source is disclosed. In one aspect, the plasma cell may include, but is not limited to, a plasma bulb configured to contain a gas suitable for generating a plasma, the plasma bulb being substantially transparent to light emanating from a pump laser configured to sustain the plasma within the plasma bulb, wherein the plasma bulb is substantially transparent to at least a portion of a collectable spectral region of illumination emitted by the plasma; and a filter layer disposed on an interior surface of the plasma bulb, the filter layer configured to block a selected spectral region of the illumination emitted by the plasma.

In another aspect, the plasma cell may include, but is not limited to, a plasma bulb configured to contain a gas suitable for generating a plasma, the plasma bulb being substantially transparent to light emanating from a pump laser configured to sustain a plasma within the plasma bulb, wherein the plasma bulb is substantially transparent to at least a portion of a collectable spectral region of illumination emitted by the plasma; and a filter assembly disposed within a volume of the plasma bulb, the filter assembly configured to block a selected spectral region of the illumination emitted by the plasma.

In another aspect, the plasma cell may include, but is not limited to, a plasma bulb configured to contain a gas suitable for generating a plasma, the bulb being substantially transparent to light emanating from a pump laser configured to sustain a plasma within the plasma bulb, wherein the plasma bulb is substantially transparent to at least a portion of a collectable spectral region of illumination emitted by the plasma; a liquid inlet arranged at a first portion of the plasma bulb; and a liquid outlet arranged at a second portion of the plasma bulb opposite the first portion of the plasma bulb, the liquid inlet and the liquid outlet configured to flow a liquid from the liquid inlet to the liquid outlet, the liquid configured to block a selected spectral region of the illumination emitted by the plasma.

In another aspect, the plasma cell may include, but is not limited to, a plasma bulb; an inner plasma cell disposed within the plasma bulb and configured to contain a gas suitable for generating a plasma; and a gaseous filter cavity formed by an outer surface of the inner plasma cell and an inner surface of the plasma bulb, the plasma bulb and the inner plasma cell being substantially transparent to light emanating from a pump laser configured to sustain a plasma within the inner plasma cell, wherein the plasma bulb and the inner plasma cell are substantially transparent to at least a portion of a collectable spectral region of illumination emitted by the plasma, wherein the gaseous filter cavity is configured to contain a gaseous filter material, the gaseous filter material configured to absorb a portion of a selected spectral region of the illumination emitted by the plasma.

In another aspect, the plasma cell may include, but is not limited to, a plasma bulb configured to contain a gas suitable for generating a plasma, the plasma bulb being substantially transparent to light emanating from a pump laser configured to sustain the plasma within the plasma bulb, wherein the plasma bulb is substantially transparent to at least a portion of a collectable spectral region of illumination emitted by the plasma; and at least one of a filter layer disposed on an interior surface of the plasma bulb, a filter assembly disposed within a volume of the plasma bulb, a liquid filter established within the volume of the plasma bulb, and a gaseous filter established within the volume of the plasma bulb.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

Referring generally to FIGS. 1 through 5, a plasma cell for ultraviolet light filtering suitable for use in a laser-sustained plasma light source is described in accordance with the present invention. In one aspect, the present invention is directed to a plasma cell equipped with a plasma bulb configured to filter short wavelength radiation (e.g., VUV radiation) emitted by the plasma sustained within the bulb in order to keep the short wavelength radiation from impinging on the interior surface of the bulb. In another aspect, the plasma bulb of the present invention is configured to allow for the transmission of a selected portion of collectable radiation (e.g., broadband radiation) emitted by the plasma. In this regard, the plasma bulb of the plasma cell of the present invention is at least partially transparent to the radiation emitted by the pump laser, used to sustain the plasma in the plasma cell, and at least partially transparent to the selected portion of collectable light emitted by the plasma within the plasma bulb. By limiting the amount of short wavelength radiation (e.g., VUV radiation) impinging on the interior surface of the plasma bulb, the present invention may reduce the amount of solarization-induced damage in the plasma bulb of a laser-sustained illumination source. In particular, the present invention may aid in reducing the degradation of plasma bulb glass caused by ultraviolet light (e.g., VUV light) emitted by the plasma within the given plasma bulb. Plasma bulb degradation leads to bulb malfunction, which requires replacement of the plasma bulb in a given laser-sustained light source. In addition, plasma bulb degradation may give rise to a plasma bulb explosion after bulb cool-down or during bulb operation. The generation of plasma within gas species is generally described in U.S. patent application Ser. No. 11/695,348, filed on Apr. 2, 2007; and U.S. patent application Ser. No. 11/395,523, filed on Mar. 31, 2006, which are incorporated herein in their entirety.

Figure 1:
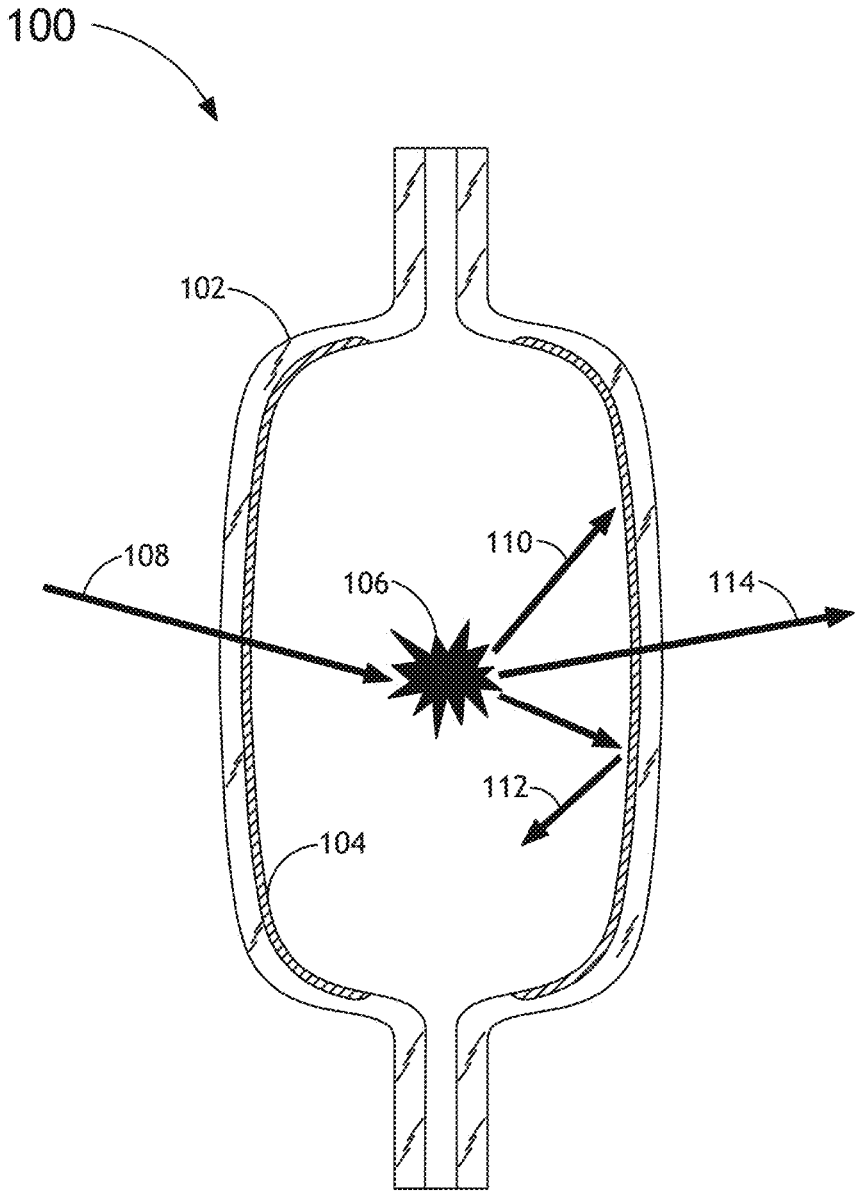
FIG. 1 illustrates a plasma cell having a plasma bulb equipped with a filter coating, in accordance with one embodiment of the present invention.

FIG. 1 illustrates a plasma cell 100 with a plasma bulb 102 equipped with a filter layer 104, in accordance with one embodiment of the present invention. In one embodiment, the plasma cell 100 of the present invention includes a plasma bulb 102 having a selected shape (e.g., cylinder, sphere, and the like) and formed from a material (e.g., glass) substantially transparent to at least a portion of the light 108 from the pumping laser source (not shown). In another embodiment, the plasma bulb 102 is substantially transparent to at least a portion of the collectable illumination (e.g., IR light, visible light, ultraviolet light) emitted by the plasma 106 sustained within the bulb 102. For example, the bulb 102 may be transparent to a selected spectral region of the broadband emission 114 from the plasma 106. In another embodiment, the filter layer 104 is disposed on an interior surface of the plasma bulb 102. In one embodiment, the filter layer 104 is suitable for blocking a selected spectral region of the illumination emitted by the plasma 106. For example, the filter layer 104 may be suitable for substantially absorbing a selected spectral region of illumination 110 emitted by the plasma 106. By way of another example, the filter layer 104 may be suitable for substantially reflecting a selected spectral region of illumination 112 emitted by the plasma 106. In a further embodiment, the filter layer 104 may be suitable for absorbing or reflecting short wavelength illumination, such as, but not limited to ultraviolet below approximately 200 nm (e.g., VUV light).

In another embodiment, the filter layer 104 may include, but is not limited to, a material deposited onto the interior surface of the bulb 102. In this regard, the filter layer 104 may include a coating material deposited onto the interior surface of the plasma bulb 102. For example, the filter layer 104 may include, but is not limited to, a coating of a hafnium oxide deposited on the interior surface of the plasma bulb 102. It is recognized herein that hafnium oxide coatings may strongly absorb light at wavelengths smaller than 220 nm, making hafnium oxide particularly useful as a filtering material in the present invention. The applicants note that the present invention is not limited to hafnium oxide as it is recognized that any coating material providing the ability to absorb or reflect light in the desired wavelength range may be suitable for implementation in the present invention. Transmission characteristics of hafnium oxide as a function of wavelength are described in detail by E. E. Hoppe et al. in J. Appl. Phys. 101, 123534 (2007), which is incorporated herein in the entirety. Additional materials suitable for implementation in the filter layer may include, but are not limited to, titanium oxide, zirconium oxide, and the like.

In another embodiment, the filter layer 104 may include a first coating formed from a first material and a second coating (not shown) formed from a second material disposed on the surface of the first coating. In one embodiment, the first coating and second coating may be formed from the same material. In another embodiment, the first coating and second coating may be formed from a different material.

In another embodiment, the filter layer 104 may include a multi-layer coating. In this regard, the multi-layer coating may be configured to provide selective reflection or absorption of different wavelengths of light.

In another embodiment, the filter layer 104 may include, but is not limited to, a microstructured layer disposed on the interior surface of the bulb 102. For example, the filter layer 104 may be formed by sub-wavelength microstructuring of the interior bulb wall of the plasma bulb 102 such that an antireflection coating is created. In this regard, the antireflection coating may be configured for a specific bandwidth of light (e.g., collectable light emitted by plasma 106). In this regard, the reflective or absorptive coating may be configured for a specific bandwidth of light (e.g., collectable light emitted by plasma 106). By way of another example, the filter layer 104 may be formed by sub-wavelength microstructuring of the interior bulb wall of the plasma bulb 102 such that an absorptive or reflective coating is created for specific bands of light (e.g., VUV).

It is further noted that microstructuring the coating of the interior surface of the plasma bulb 102 such that a significant degree of roughness is achieved may result in a lowering of stress experienced by the bulb wall upon solarization.

In another embodiment, the filter layer 104 may include, but is not limited to, nanocrystals, which are suitable for absorbing a specific wavelength band (e.g., UV light). It is noted herein that nanocrystals may have tunable absorption bands. In this regard, the absorption bands of nanocrystals are tunable by varying the size of the utilized nanocrystals. It is further noted that nanocrystals may possess robust absorption properties. It is recognized herein that a particular wavelength band (e.g., UV or VUV) may be filtered out of the illumination emitted by the plasma 106 utilizing a filter layer 104 that includes a selected amount of a particular nanocrystal tuned to absorb or reflect the particular wavelength band in question. In this manner, the selection of a specific nanocrystal for implementation in the present invention may depend on the specific band of interest to be filtered out of the illumination, which in turn dictates the size (e.g., mean size, average size, minimum size, maximum size and the like) of the nanocrystals.

In a further aspect, the one or more filter layers 104 may provide mechanical protection to the plasma bulb 102. In this regard, the filter layer 104 deposited on the interior surface of the plasma bulb 102 may act to reinforce the plasma bulb 102, which in turn will reduce the likelihood of mechanical breakdown (e.g., bulb explosion) of the plasma bulb 102.

In another embodiment, the filter layer 104 may include, but is not limited to, a sacrificial coating. It is noted herein that the filter layer 104 may be subject to damage from light emitted by the plasma 106 and gradually decompose, peel, delaminate, or form into particulates. In this manner, a sacrificial coating that allows for the continued operation of the bulb 102 even after degradation of the sacrificial coating may be implemented in the filter layer 104 of the present invention.

Figure 6:
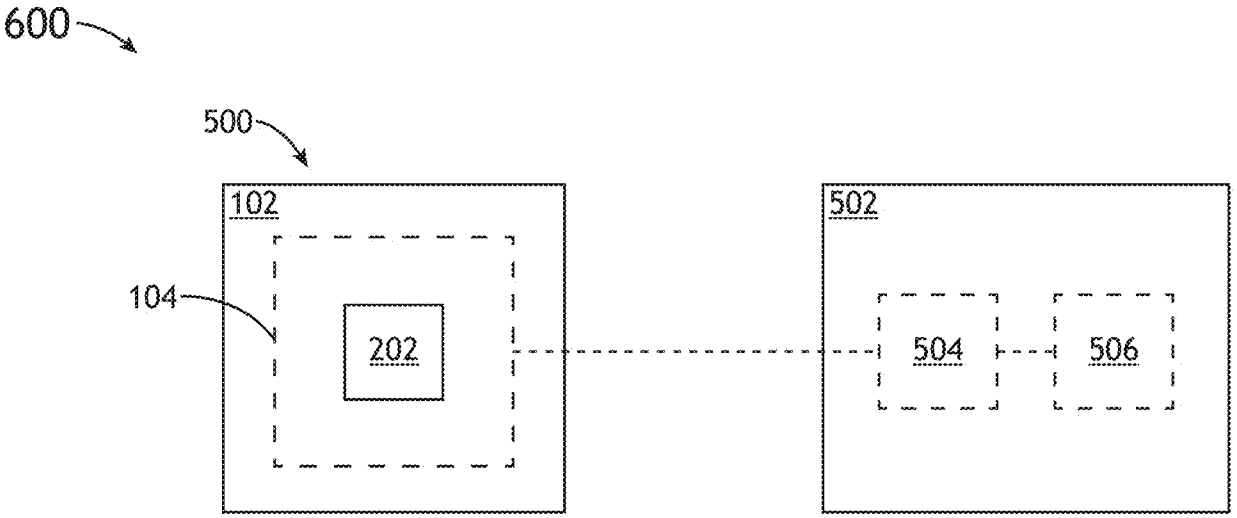
FIG. 6 illustrates a system including a plasma cell having a plasma bulb equipped with a filter coating and a filter assembly, and a thermal management sub-system including a heat exchanger and a heat sink, in accordance with one embodiment of the present invention.

In another aspect, the one or more filter layers 104 may be configured to cool the bulb wall(s) of the plasma bulb 102. In this regard, the filter layer 104 deposited on the interior surface of the plasma bulb 102 may be thermally coupled to a thermal management sub-system 502, as illustrated in system 600 of FIG. 6 in accordance with one embodiment of the present invention. The thermal management sub-system 502 may include, but is not limited to, a heat exchanger 504 and a heat sink 506. In this sense, the filter layer 104 may transfer heat from the bulb wall to the heat sink 506 via a heat exchanger 504, which thermally couples the heat sink 506 and filter layer 104.

In another aspect, the bulb 102 of the plasma cell 100 may be formed from a material, such as glass, being substantially transparent to one or more selected wavelengths (or wavelength ranges) of the illumination from an associated pumping source, such as a laser, and the collectable broadband emissions from the plasma 106. The glass bulb may be formed from a variety of glass materials. In one embodiment, the glass bulb may be formed from fused silica glass. In further embodiments, the glass bulb 102 may be formed from a low OH content fused synthetic quartz glass material. In other embodiments, the glass bulb 102 may be formed from high OH content fused synthetic silica glass material. For example, the glass bulb 102 may include, but is not limited to, SUPRASIL 1, SUPRASIL 2, SUPRASIL 300, SUPRASIL 310, HERALUX PLUS, HERALUX-VUV, and the like. Various glasses suitable for implementation in the glass bulb of the present invention are discussed in detail in A. Schreiber et al., *Radiation Resistance of Quartz Glass for VUV Discharge Lamps*, J. Phys. D: Appl. Phys. 38 (2005), 3242-3250, which is incorporated herein in the entirety.

In another aspect, the bulb 102 of the plasma cell 100 may have any shape know in the art. For example, the bulb 102 may have, but is not limited to, one of the following shapes: a cylinder, a sphere, a prolate spheroid, an ellipsoid or a cardioid.

It is contemplated herein that the refillable plasma cell 100 of the present invention may be utilized to sustain a plasma in a variety of gas environments. In one embodiment, the gas of the plasma cell 100 may include an inert gas (e.g., noble gas or non-noble gas) or a non-inert gas (e.g., mercury). For example, it is anticipated herein that the volume of gas of the present invention may include argon. For instance, the gas may include a substantially pure argon gas held at pressure in excess of 5 atm. In another instance, the gas may include a substantially pure krypton gas held at pressure in excess of 5 atm. In a general sense, the glass bulb 102 may be filled with any gas known in the art suitable for use in laser sustained plasma light sources. In addition, the fill gas may include a mixture of two or more gases. The gas used to fill the gas bulb 102 may include, but is not limited to, Ar, Kr, $N_2$, $Br_2$, $I_2$, $H_2O$, $O_2$, $H_2$, $CH_4$, NO, $NO_2$, $CH_3OH$, $C_2H_5OH$, $CO_2$ one or more metal halides, an Ne/Xe, AR/Xe, or Kr/Xe, Ar/Kr/Xe mixtures, ArHg, KrHg, and XeHg and the like. In a general sense, the present invention should be interpreted to extend to any light pump plasma generating system and should further be interpreted to extend to any type of gas suitable for sustaining plasma within a plasma cell.

In another aspect of the present invention, the illumination source used to pump the plasma 106 of the plasma cell 100 may include one or more lasers. In a general sense, the illumination source may include any laser system known in the art. For instance, the illumination source may include any laser system known in the art capable of emitting radiation in the visible or ultraviolet portions of the electromagnetic spectrum. In one embodiment, the illumination source may include a laser system configured to emit continuous wave (CW) laser radiation. For example, in settings where the gas of the volume is or includes argon, the illumination source may include a CW laser (e.g., fiber laser or disc Yb laser) configured to emit radiation at 1069 nm. It is noted that this wavelength fits to a 1068 nm absorption line in argon and as such is particularly useful for pumping the gas. It is noted herein that the above description of a CW laser is not limiting and any CW laser known in the art may be implemented in the context of the present invention.

In another embodiment, the illumination source may include one or more diode lasers. For example, the illumination source may include one or more diode lasers emitting radiation at a wavelength corresponding with any one or more absorption lines of the species of the gas of the plasma cell 100. In a general sense, a diode laser of the illumination source may be selected for implementation such that the wavelength of the diode laser is tuned to any absorption line of any plasma (e.g., ionic transition line) or an absorption line of the plasma-producing gas (e.g., highly excited neutral transition line) known in the art. As such, the choice of a given diode laser (or set of diode lasers) will depend on the type of gas utilized in the plasma cell 100 of the present invention.

In one embodiment, the illumination source may include one or more frequency converted laser systems. For example, the illumination source may include a Nd:YAG or Nd:YLF laser. In another embodiment, the illumination source may include a broadband laser. In another embodiment, the illumination source may include a laser system configured to emit modulated laser radiation or pulse laser radiation.

In another aspect of the present invention, the illumination source may include two or more light sources. In one embodiment, the illumination source may include two or more lasers. For example, the illumination source (or illumination sources) may include multiple diode lasers. By way of another example, the illumination source may include multiple CW lasers. In a further embodiment, each of the two or more lasers may emit laser radiation tuned to a different absorption line of the gas or plasma within the plasma cell.

Figure 2:
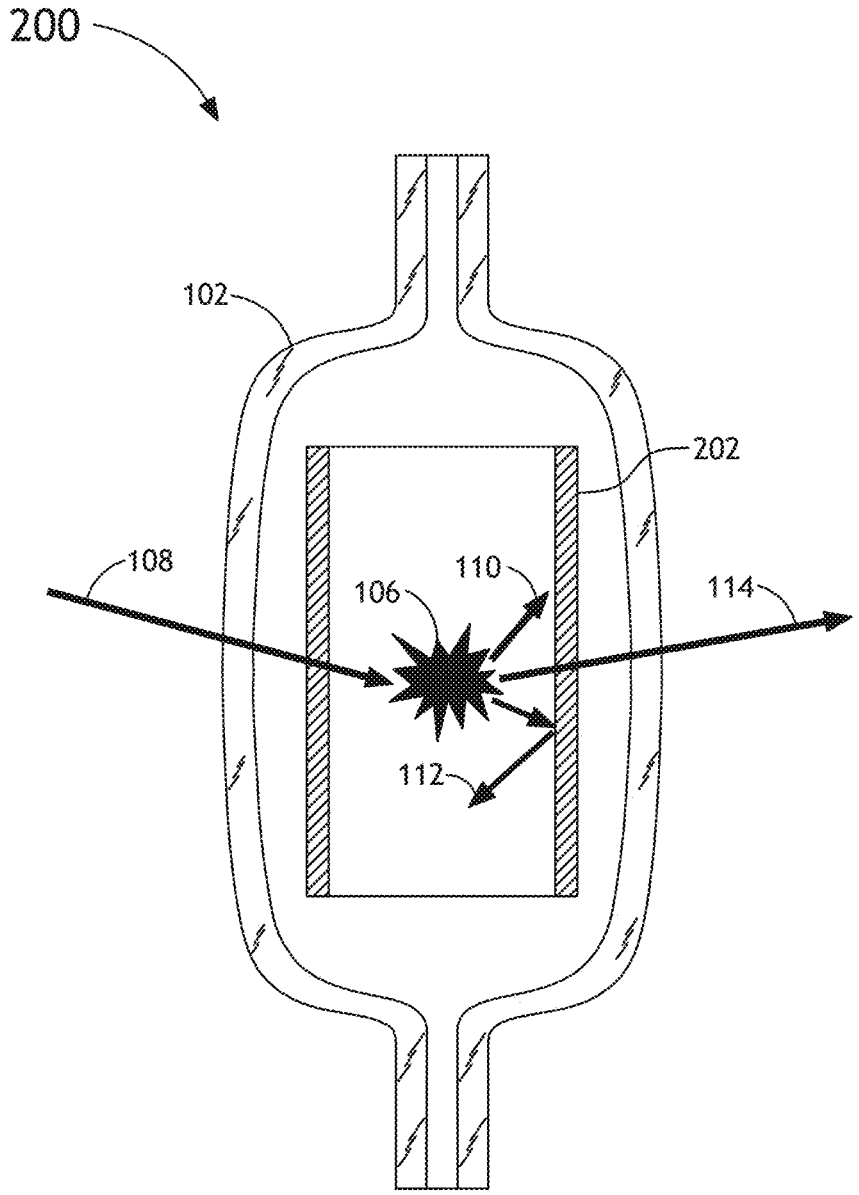
FIG. 2 illustrates a plasma cell having a plasma bulb equipped with a filter assembly, in accordance with one embodiment of the present invention.

FIG. 2 illustrates a plasma cell 200 having a plasma bulb 102 equipped with a filter assembly 202 disposed within the volume of the plasma bulb 102, in accordance with an alternative embodiment of the present invention. It is noted herein that the types of gas fills, glass bulb materials, bulb shapes, and laser-pumping sources discussed previously herein with respect to FIG. 1 should be interpreted to extend to the plasma cell 200 of the present disclosure unless otherwise noted.

It is further noted herein that in the present embodiment the filtering (i.e., reflection or absorption) as described previously herein is accomplished via the filter assembly 202. In this regard, the filter assembly 202 is suitable for blocking a selected spectral region of the illumination emitted by the plasma 106. For example, the filter assembly 202 may be suitable for substantially absorbing a selected spectral region of illumination 110 emitted by the plasma 106. By way of another example, the filter assembly 202 may be suitable for substantially reflecting a selected spectral region of illumination 112 emitted by the plasma 106. In a further embodiment, the filter assembly 202 may be suitable for absorbing or reflecting short wavelength illumination, such as, but not limited to ultraviolet below approximately 200 nm (e.g., VUV light).

In another embodiment, the filter assembly 202 is mechanically coupled to an internal surface of the plasma bulb 102. It is noted herein that the filter assembly 202 may be mechanically coupled to the internal surface of the plasma bulb 102 in any manner known in the art.

In one aspect, the filter assembly 202 is formed from a first material, while the plasma bulb 102 is formed from a second material. In one embodiment, the filter assembly 202 is made of glass material of a different type than that of the bulb 102. It is recognized herein that different absorption properties of the glass of the filter assembly 202 may allow for protection of the glass of the bulb 102.

In one embodiment, the filter assembly 202 is made of glass of the same type as the glass of the bulb 102. In another embodiment, the glass material of filter assembly 202 is held at the same temperature as the glass material of bulb 102. It is recognized herein that absorption of radiation by the filter assembly 202 acts to protect the bulb glass 102 from radiation exposure (e.g., VUV light exposure). In this setting, solarization damage incurred by the filter assembly 202 does not compromise the structural integrity of the bulb 102. Even in cases where the filter assembly 202 cracks, bulb 102 malfunction (e.g., bulb explosion due to high pressure within bulb) does not occur.

In another embodiment, the glass of the bulb 102 is maintained at a different temperature than the glass of the filter assembly 202. For instance, the glass of the filter assembly 202 may be maintained at a temperature higher than the temperature of the glass of the bulb 102. It is recognized herein that since glass absorption properties may change significantly as a function of temperature, absorption properties of the filter assembly 202 may be configured to protect the bulb glass 102 from radiation (e.g., VUV light). In a further embodiment, solarization damage incurred by the filter assembly 202 may be annealed by the elevated temperature of the filter assembly 202. For example, the filter assembly 202 may be maintained at a temperature of approximately 1200° C., where the glass of filter assembly 202 softens and rapidly anneals. It is further noted herein that since the filter assembly 202 does not carry the structural load of the bulb 102, softening of the glass of the filter assembly 202 does not compromise the structural integrity of the bulb 102. In contrast, in a setting where the bulb 102 is kept at an elevated temperature, leading to softening of the glass of the bulb 102, the high gas pressure within the bulb 102 may lead to an explosion of the bulb 102.

In another embodiment, the filter assembly 202 may be formed by depositing a coating material onto an assembly (e.g., glass assembly), wherein the assembly is mounted within the volume of the plasma bulb 102. It is recognized herein that the coating material used in the filter assembly 202 may consist of one or more of the coating materials (e.g., hafnium oxide and the like) described previously herein with respect to the filter layer 104.

In another embodiment, the filter assembly 202 may be formed out of sapphire. Those skilled in the art should recognize that sapphire is generally suitable for absorbing illumination in the VUV band. In a further embodiment, the filter assembly 202 may consist of a thin rolled sheet of sapphire. For example, a sheet of sapphire may be rolled into a generally cylindrical shape and disposed within the volume of the plasma bulb 102. For example, the sapphire sheet may have a thickness of approximately 5-20 mm.

In another embodiment, the filter assembly 202 may include a microstructured filter assembly. In this regard, a surface of the filter assembly 202 may be microstructured in a manner similar to that described previously herein with respect to the microstructured surface of the bulb 102 surface.

In another embodiment, the filter assembly 202 may include a sacrificial filter assembly. In this regard, the filter assembly 202 may degrade or fail, while the integrity of the plasma bulb 102 is maintained.

Figure 3:
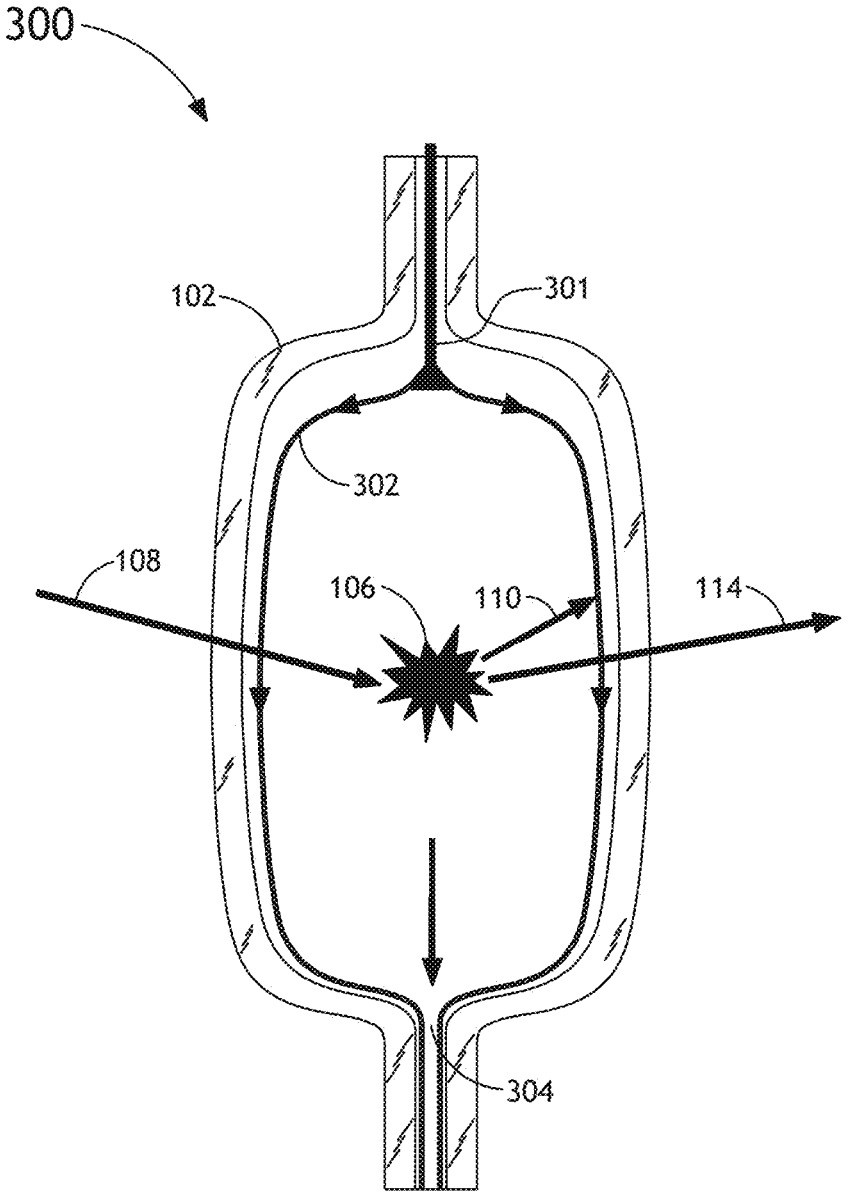
FIG. 3 illustrates a plasma cell having a plasma bulb configured for utilization of a liquid filter, in accordance with one embodiment of the present invention.

FIG. 3 illustrates a plasma cell 300 having a plasma bulb 102 equipped with a liquid inlet 301 and liquid outlet 304 configured to flow a liquid along the internal surface of the plasma bulb 102 of the plasma cell 300, in accordance with an alternative embodiment of the present invention. It is noted herein that the types of gas fills, glass bulb materials, and laser-pumping sources discussed previously herein with respect to FIG. 1 should be interpreted to extend to the plasma cell 300 of the present disclosure unless otherwise noted.

In one aspect, the plasma cell 300 includes a liquid inlet 301 arranged at a first portion of the plasma bulb 102. In another aspect, the plasma cell 300 includes a liquid outlet 304 arranged at a second portion of the plasma bulb 102 opposite the first portion of the plasma bulb 102. In a further aspect, the liquid inlet 301 and the liquid outlet 304 are configured to flow a liquid 302 from the liquid inlet 301 to the liquid outlet 304 in order to coat at least a portion of an internal surface of the plasma bulb 102 with the liquid 302. In a further embodiment, the liquid inlet 301 may include one or more (e.g., 1, 2, 3, 4, and etc.) jets suitable for distributing the liquid 302 about the interior surface of the bulb 102. In an additional aspect, the liquid 302 is configured to block (e.g., absorb) a selected spectral region of the illumination emitted by the plasma 106.

In an alternative embodiment, the liquid inlet 301 and the liquid outlet 304 are configured to flow a liquid 302 from the liquid inlet 301 to the liquid outlet 304 in order to form a stand-alone sheath, or curtain, of the liquid 302 within the volume of the plasma bulb 102. In this regard, the sheath of liquid need not be in contact within the internal surface of the plasma bulb 102. In a further embodiment, the sheath of liquid 302 may be formed within the volume of the plasma bulb 102 utilizing one or more (e.g., 1, 2, 3, 4, and etc.) jets in the liquid inlet 301.

In another embodiment, the plasma cell 300 may further include an actuation assembly configured to at least partially rotate the plasma bulb 102 in order to distribute the liquid 302 about at least a portion of the interior surface of the plasma bulb 102.

In one embodiment, liquid 302 may include one or more radiation absorbing agents. In this regard, a liquid 302 may carry a selected absorbing agent from the liquid inlet 301 to the liquid outlet 304. In another embodiment, the absorbing agent may include one or more dye materials. In a further embodiment, the dye material present in the liquid 302 is configured to absorb a selected wavelength band (e.g., UV light or VUV light). It is recognized herein that the particular dye used in the plasma cell 300 may be selected based on the particular radiation absorption properties required of the plasma cell 300.

In another embodiment, the absorbing agent may include one or more nanocrystalline materials (e.g., titanium dioxide). In a further embodiment, the nanocrystalline material present in the liquid 302 is configured to absorb a selected wavelength band (e.g., UV light or VUV light). It is recognized herein that the particular nanocrystalline material used in the plasma cell 300 may be selected based on the particular radiation absorption properties required of the plasma cell 300. As previously note herein, nanocrystals have absorption bands which are tunable by varying the size of nanocrystals and have very robust absorption properties. In this regard, the particular type and size of nanocrystals used in the plasma cell 300 may be selected based on the particular radiation absorption properties required of the plasma cell 300.

In a further aspect, it is recognized that the material (e.g., dye material, nanocrystalline material, and etc.) carried by the liquid 302 may be changed based on the needs of the plasma cell 300. For example, over a first time period the liquid 302 may carry a first material dissolved or suspended in the liquid 302, while over a second time period the liquid 302 may carry a second material dissolved or suspended in the liquid 302.

In another embodiment, the liquid 302 of plasma cell 300 may include any liquid known in the art. For example, the liquid 302 may include, but is not limited to, water, methanol, ethanol, and the like. Light absorption characteristics of water are discussed in detail by W. H. Parkinson et al. in W. H. Parkinson and K. Yoshino, *Chemical Physics* 294 (2003) 31-35, which is incorporated herein by reference in the entirety. It is noted herein that water displays a strong absorption cross-section for VUV wavelengths below 190 nm. It is recognized herein that any liquid possessing the absorption characteristics needed to "block" the selected band of interest may be suitable for implementation in the present invention.

Figure 4:
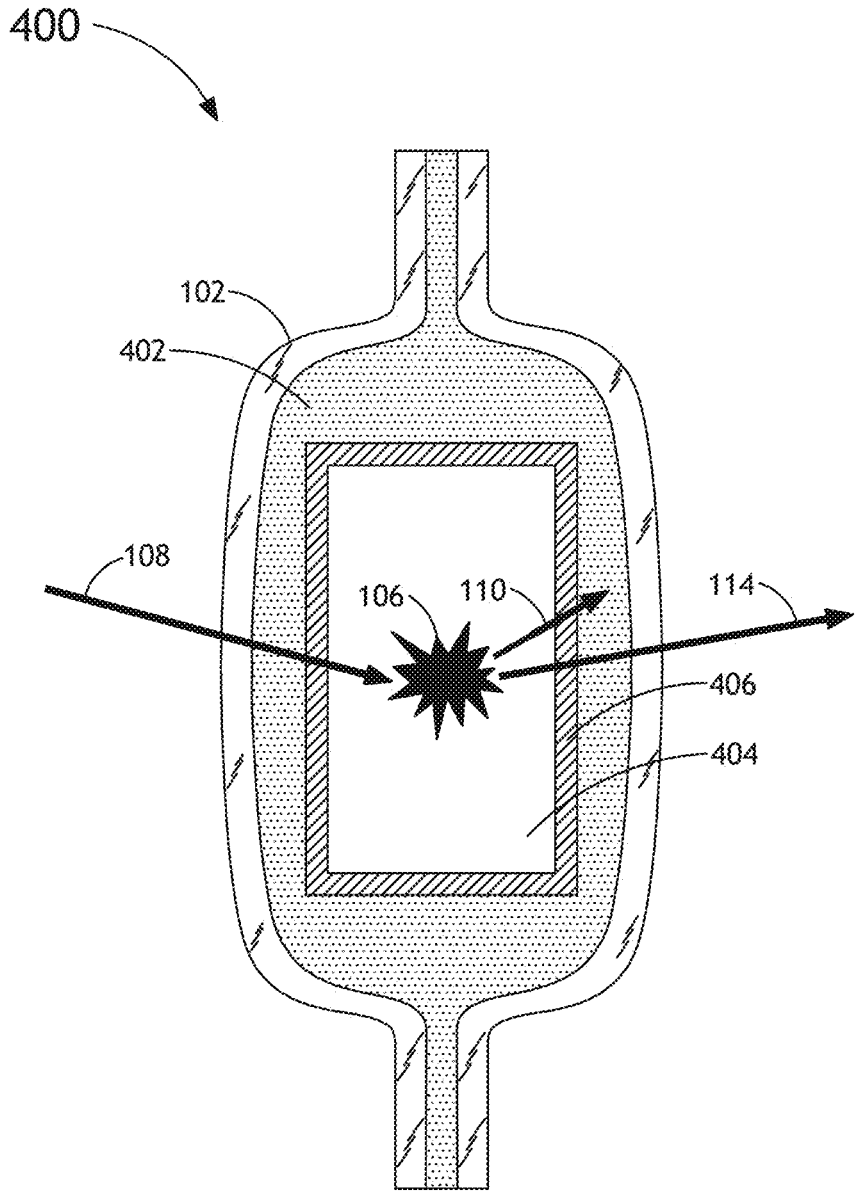
FIG. 4 illustrates a plasma cell having a plasma bulb having an inner plasma cell and a gaseous filter cavity, in accordance with one embodiment of the present invention.

FIG. 4 illustrates a plasma cell 400 having a plasma bulb 102 equipped with an inner plasma cell 406 disposed within the plasma bulb 102 and a gaseous filter cavity 402 formed by the outer surface of the inner cell 406 and the inner surface of the bulb wall of the plasma bulb 102. It is noted herein that the types of gas fills, glass bulb materials, and laser-pumping sources discussed previously herein with respect to FIG. 1 should be interpreted to extend to the plasma cell 400 of the present disclosure unless otherwise noted.

It is recognized herein that the plasma bulb 102 and the inner plasma cell 406 are substantially transparent to light emanating from a pump laser configured to sustain a plasma 106 within the volume 404 of the inner plasma cell 406. In a further aspect, the plasma bulb 102 and the inner plasma cell 406 are substantially transparent to at least a portion of a collectable spectral region of illumination 114 emitted by the plasma 106. In a further aspect, the gaseous filter cavity is configured to contain a gaseous filter material 402. In a further embodiment, the gaseous filter material 402 is configured to absorb a portion of a selected spectral region of the illumination 110 emitted by the plasma 106. It is noted herein that the gaseous filter material 402 may include any gas known in the art suitable for absorbing light of the selected band (e.g., UV or VUV light).

Figure 5:
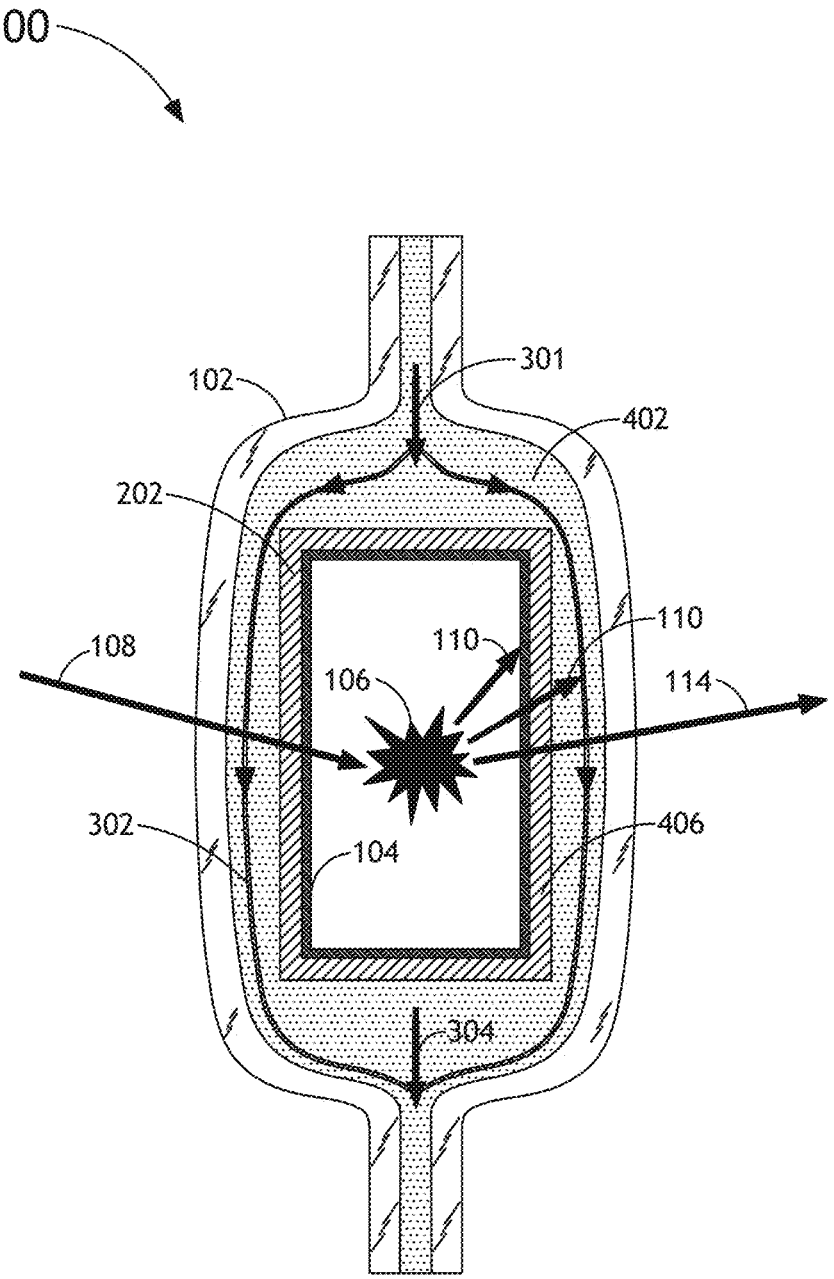
FIG. 5 illustrates a plasma cell having a plasma bulb equipped with a filter coating, filter assembly and an inner plasma cavity, in accordance with one embodiment of the present invention.

FIG. 5 illustrates a plasma cell 500 implementing, in combination, two or more of the various features described previously herein. It is noted herein that the types of gas fills, glass bulb materials, and laser-pumping sources discussed previously herein with respect to FIG. 1 should be interpreted to extend to the plasma cell 500 of the present disclosure unless otherwise noted. In this regard, the plasma cell 500 may implement two or more of the following features: filter layer 104, filter assembly 202, liquid filter 302, and gaseous filter 402. It is recognized herein that each of the various features described above may be utilized to filter out different spectral regions of the radiation emitted by the plasma 106. It is further recognized herein that the various features described above may be configured to operate over different operating regimes (e.g., temperature, pressure, and the like).

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

What is claimed:

1. A plasma cell comprising:

a plasma bulb configured to contain a gas suitable for generating a plasma, the bulb being substantially transparent to light emanating from a pump laser configured to sustain a plasma within the plasma bulb, wherein the plasma bulb is substantially transparent to at least a portion of a collectable spectral region of illumination emitted by the plasma;

a liquid inlet arranged at a first portion of the plasma bulb; and a liquid outlet arranged at a second portion of the plasma bulb opposite the first portion of the plasma bulb, the liquid inlet and the liquid outlet configured to flow a liquid from the liquid inlet to the liquid outlet, the liquid configured to block a selected spectral region of the illumination emitted by the plasma; and an actuation assembly configured to at least partially rotate the plasma bulb in order to distribute the liquid about at least a portion of the interior surface of the plasma bulb.

2. The plasma cell of claim 1, wherein the liquid inlet and the liquid outlet are configured to flow a liquid from the liquid inlet to the liquid outlet in order to coat at least a portion of an internal surface of the plasma bulb with the liquid.

3. The plasma cell of claim 1, wherein the liquid inlet and the liquid outlet are configured to flow a liquid from the liquid inlet to the liquid outlet in order to form a stand-alone sheath of the liquid within the volume of the plasma bulb.

4. The plasma cell of claim 1, wherein the liquid comprises:

at least one of water, methanol, or ethanol.

5. The plasma cell of claim 1, wherein the liquid includes at least one of nanocrystalline material and dye material.

6. The plasma cell of claim 1, further comprising:

an active liquid distributor jet configured to transfer liquid from the liquid inlet to the liquid outlet along one or more pathways about at least one of a portion of the interior surface of the plasma bulb.

7. The plasma cell of claim 1, further comprising:

an active liquid distributor jet configured to transfer liquid from the liquid inlet to the liquid outlet in order to form a stand-alone sheath within the volume of the plasma bulb.

8. A plasma cell comprising:

a plasma bulb configured to contain a gas suitable for generating a plasma, the plasma bulb being substantially transparent to light emanating from a pump laser configured to sustain the plasma within the plasma bulb, wherein the plasma bulb is substantially transparent to at least a portion of a collectable spectral region of illumination emitted by the plasma; and a liquid filter established within the volume of the plasma bulb, wherein the liquid filter is established by an actuation assembly configured to at least partially rotate the plasma bulb in order to distribute the liquid about at least a portion of the interior surface of the plasma bulb.

* * * * *